United States Patent [19]

Iwahara

[11] 4,209,665

[45] Jun. 24, 1980

[54] AUDIO SIGNAL TRANSLATION FOR LOUDSPEAKER AND HEADPHONE SOUND REPRODUCTION

[75] Inventor: Makoto Iwahara, Yokohama, Japan

[73] Assignee: Victor Company of Japan, Limited, Yokohama, Japan

[21] Appl. No.: 937,764

[22] Filed: Aug. 29, 1978

[30] Foreign Application Priority Data

| | | | |
|---|---|---|---|
| Aug. 29, 1977 | [JP] | Japan | 52-103360 |
| Sep. 5, 1977 | [JP] | Japan | 52-107082 |
| Sep. 7, 1977 | [JP] | Japan | 52-106813 |
| Sep. 7, 1977 | [JP] | Japan | 52-106814 |

[51] Int. Cl.[2] ..... H04R 5/04

[52] U.S. Cl. ..... 179/1 G

[58] Field of Search ..... 179/1 G, 1 GP, 100.4 ST, 179/1 D, 1 GQ

[56] References Cited

U.S. PATENT DOCUMENTS

| | | | |
|---|---|---|---|
| 4,118,599 | 10/1978 | Iwahara et al. | 179/1 GP |
| 4,136,260 | 1/1979 | Asahi | 179/1 G |
| 4,139,728 | 2/1979 | Haramoto et al. | 179/1 G |

FOREIGN PATENT DOCUMENTS

| | | | |
|---|---|---|---|
| 2308267 | 11/1976 | France | 179/1 G |

*Primary Examiner*—Douglas W. Olms

*Attorney, Agent, or Firm*—Lowe, King, Price & Becker

[57] ABSTRACT

A signal translator includes right- and left-channel translating networks, each being constructed to have a transfer function 1/(A+B), where A is the transfer function of a direct acoustic path between a right-channel sound source and a listener's ear and B is the transfer function of an acoustic crosstalk path between a left-channel sound source and the listener's ear. Through the right- and left-channel networks, the right and left channel components of spatially correlated audio signals undergo transformation of 1/(A+B). When binaural signals are applied to the translating networks, the translated output signals are applied to a pair of loudspeakers in a listening room in which the acoustic direct and crosstalk paths transform the signals so that the impinging sound at the listener's ears is a distortion-free audio signals. The input signals may be a pair of stereophonic signals, which after translation through the respective translating networks, are applied to a stereophonic headphone having a transfer function (A+B) to give the listener the same psychoacoustic effect as that obtained from the reproduction of the stereophonic signals with loudspeakers.

10 Claims, 16 Drawing Figures

LISTENER
ER
EL
8
A
B
B
A
18
28
SR
SL
40
41
51
43
53
B/A
B/A
42
52
XFER CKTS
16
OR
OL
26
10
XFER CKT
15
B/A
14
24
25
B/A
XFER CKT
13
I/A
23
I/A
XFER CKTS
IR
IR
FROM PHONES MICRO-5

AUDIO SIGNAL TRANSLATION FOR LOUDSPEAKER AND HEADPHONE SOUND REPRODUCTION

BACKGROUND OF THE INVENTION

The present invention relates to signal translation of audio signals to compensate for the difference in performance between loudspeaker and heaphone reproduction systems.

In loudspeaker reproduction, acoustic crosstalk paths are present between the right-channel speaker and the listener's left ear and between the left-channel speaker and the listener's right ear, in addition to the direct paths through which the sound travels to the nearest ears, while there is no such crosstalk path in headphone reproduction. It is probable that if binaural signals are broadcast, the signals may be received by an equipment having no headphone so that the received signals are reproduced through loudspeakers. In such cases, the listener would feel different acoustic impression from what he would when he uses a headphone. This is because binaural signals are originally intended for headphone reproduction. The speaker reproduction of such binaural signals would result in waveform distortions and loss of sonic localization due to the presence of the undesirable crosstalk paths in the listening room. Similarly, the reproduction of stereophonic signals, which have been derived from a pair of microphones in an open space, through a headphone would produce a different impression to the listener from what he would have when he hears the signals in an open space because of the absence of crosstalk paths in the headphone.

SUMMARY OF THE INVENTION

The primary object of the present invention is therefore to provide signal translators which compensate for the difference in acoustic transmission path between loudspeaker and headphone reproduction systems.

The present invention is based on a discovery that there is a similarity between the acoustic transfer characteristic of an artificial head with respect to the impinging sound and the transfer function of the direct acoustic path from each of a pair of loudspeakers to a listener's ear in so far as the listener is seated to subtend an angle of approximately 60 degrees to the speakers.

In accordance with the present invention, the signal translator comprises right- and left-channel translating networks each being constructed to have a transfer function $1/(A+B)$, where A is the transfer function of the direct acoustic path and B is the transfer function of the crosstalk path. Binaural signals are applied to the translator to undergo transformation of $1/(A+B)$ through the translating networks respectively and are transmitted through an open space to the listener's ears. Because of the presence of the crosstalk path having the transfer function B as well as the direct path having the transfer function A, the listener would hear sound without waveform distortions due to the presence of the crosstalk.

Stereophonic signals may be applied to the right- and left-channel translating networks to undergo a transformation of $1/(A+B)$, respectively. This signal translation is suitable for application to a stereophonic headphone having a transfer function $(A+B)$. Because of the absence of the crosstalk path, the transformed signal that energizes the headphone is further transformed by the transfer function of the headphone so that the listener will have the same impression as he would when he hears sound in a listening room.

In one embodiment of the invention, each of the right- and left-channel translating networks comprises a first transfer circuit having a transfer function $1/A$, a subtractive circuit having a first input terminal in receipt of the output from the transfer circuit and a second input terminal, a second transfer circuit having a transfer function $B/A$, and a negative feedback circuit connected to the output of the subtractive circuit to provide a negative feedback signal through the second transfer circuit to the second input terminal of the subtractive network to be algebraically combined with the output from the first transfer circuit. The ratio $B/A$ is called in this specification a crosstalk ratio so that the second transfer circuit is a circuit which provides a translation of the input signal by the factor of the crosstalk ratio. The application of the respective channel binaural signal to the first transfer circuit allows an output signal to appear at the output of the subtractive circuit as a transformation of the waveform in accordance with a transfer function $1/(A+B)$.

A scaling element or attenuator may be provided in the circuit between the output of the second transfer circuit and the second input terminal of the subtractive circuit to scale down the negative feedback signal. This scaling serves to vary the overall frequency response characteristic of the translating network as desired to give a distortion free sound in respect of sonic locations other than the frontal direction of the listener.

Each of the translating networks may be coupled to a crosstalk cancellation network which serves to translate the distortionless audio input signal therefrom into a localized, distortionless audio signal which bears information as to the localization of sonic images. This localization is accomplished by first translating the audio input signal by a transfer function or crosstalk ratio $B/A$, algebraically adding together the transformed audio signal with the non-transformed direct audio input signal, and combining the output of the other channel in negative phase with the direct input signal prior to the transformation of $B/A$.

In a second embodiment of the invention, each of the right- and left-channel translating networks comprises a subtractive circuit having a first input terminal in receipt of one of the spatially-correlated audio signals and a second input terminal in receipt of an output signal from the other channel to provide algebraic subtraction of the input signals, the output signal being applied to a transfer circuit having a crosstalk ratio transfer function $B/A$. An additive circuit is provided having a first input terminal in receipt of said audio signal that is applied to the first input of the subtractive circuit and a second input terminal in receipt of the output signal from the transfer circuit. The output signal from the additive network is a transformation of the input audio signal in accordance with a transfer function $1/(A+B)$.

Another object of the invention is to provide a signal translator which translates a pair of binaurally correlated signals to have a characteristic which upon reproduction by a loudspeaker produces no waveform distortion and which translates a pair of stereophonic signals to have a characteristic which upon reproduction on a stereophonic headphone produces the same psychoacoustic effect as that obtained from loudspeaker reproduction.

BRIEF DESCRIPTION OF THE DRAWINGS

These and other objects, features and advantages of the present invention will be understood from the following detailed description when read in conjunction with the accompanying drawings, in which.

DETAILED DESCRIPTION

Figure 1:
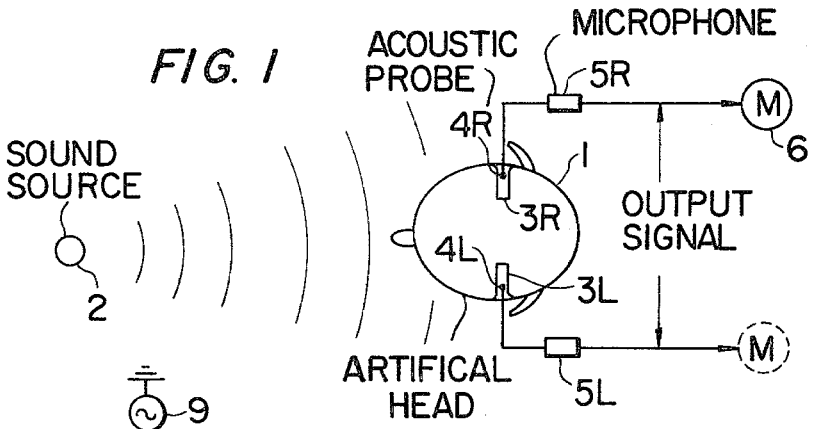
FIGS. 1 and 2 are illustrations of the principle of the present invention.
Figure 2:
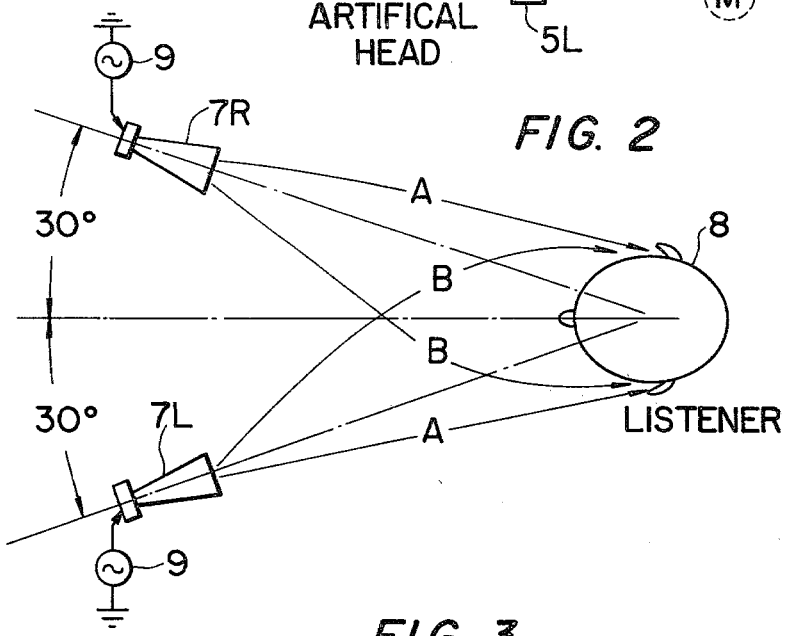

Before going into the details of the present invention, reference is first had to FIGS. 1 and 2 for clear understanding of the invention. In FIG. 1, an artificial head 1 is located facing toward a sound source 2 which emits acoustic energy at a constant energy level over the full range of audible frequencies. The artificial head 1 simulates a human head in shape and dimensions and is provided with ear canals 3 in the corresponding positions. An acoustic probe 4 is inserted into each one of the ear canals 3 to detect the sound pressure variations caused by the impression of acoustic energy transmitted from the sound source 2. The detected sound pressure is acoustically transmitted to a transducer or microphone 5 wherein the acoustic energy is translated into electrical energy. A measuring device 6 is coupled to each of the outputs from the microphone 5 and the frequency of the sound source is swept across the full range of audible frequencies to measure the frequency response of the artificial head at the position of each ear. This results in curve A' of FIG. 3. Apparently, the frequency response of the artificial head as determined by the arrangement of FIG. 1 has two resonant peaks in the higher frequency range of the spectrum.

Figure 3:
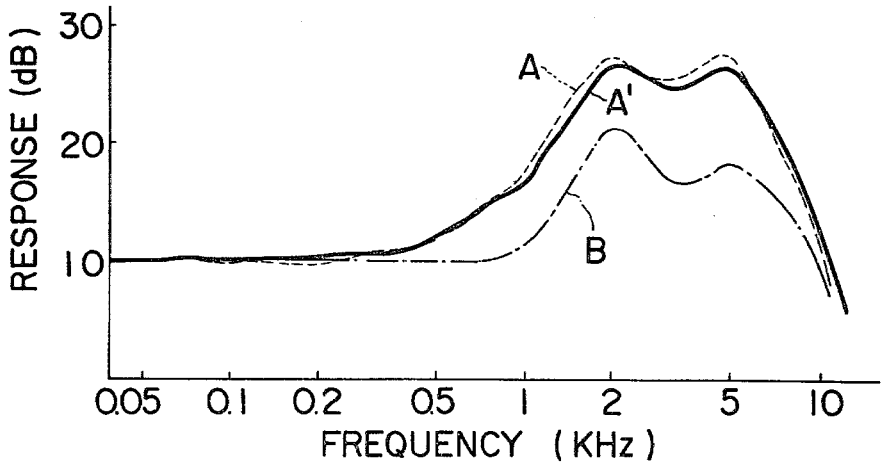
FIG. 3 is a graphic representative of the characteristics obtained from the arrangements of FIGS. 1 and 2.

In FIG. 2, a pair of loudspeakers 7 is provided angularly spaced apart by 30° from the line leading to the position of a listener 8. Each loudspeaker is supplied with an electrical signal having a constant signal level over the full range of audible frequencies from each signal source 9. The sound pressure measuring devices as employed in FIG. 1 are attached to the listener's right ear to measure its frequency response with respect to the speakers 7R and 7L. The frequency response of the listener's right ear, i.e. the transfer function of the acoustic path A, is plotted as indicated by curve A of FIG. 3 as the acoustic energy is emitted from the right speaker 7R. Speaker 7L is then switched in to emit the same acoustic energy which is received at the right ear. This results in a curve B as shown in FIG. 3. This similarity between curves A' and A is valid for situations in which the listener is located so as to subtend an angle of up to about 60° between the center line of the listener and each of the right and left speakers. Because of the symmetricity of the listener 8 with respect to the speakers 7R and 7L, identical curves A and B are obtained at the listener's left ear.

Since binaural signals are correlated to each other with the characteristics of the facial contour of an artificial head there is a clue in the binaural signals to reproduction of true realism. However, such binaural signals are only suitable for headphone reproduction; the binaural signals are not suitable for loudspeaker reproduction since interference occurs between sound impinging over a direct path from one speaker and sound impinging over a crosstalk path from the other speaker.

The embodiments which will be described below provide compatibility between binaural headphone and binaural loudspeaker reproductions utilizing the principle set out with reference to FIGS. 1–3.

Figure 4:
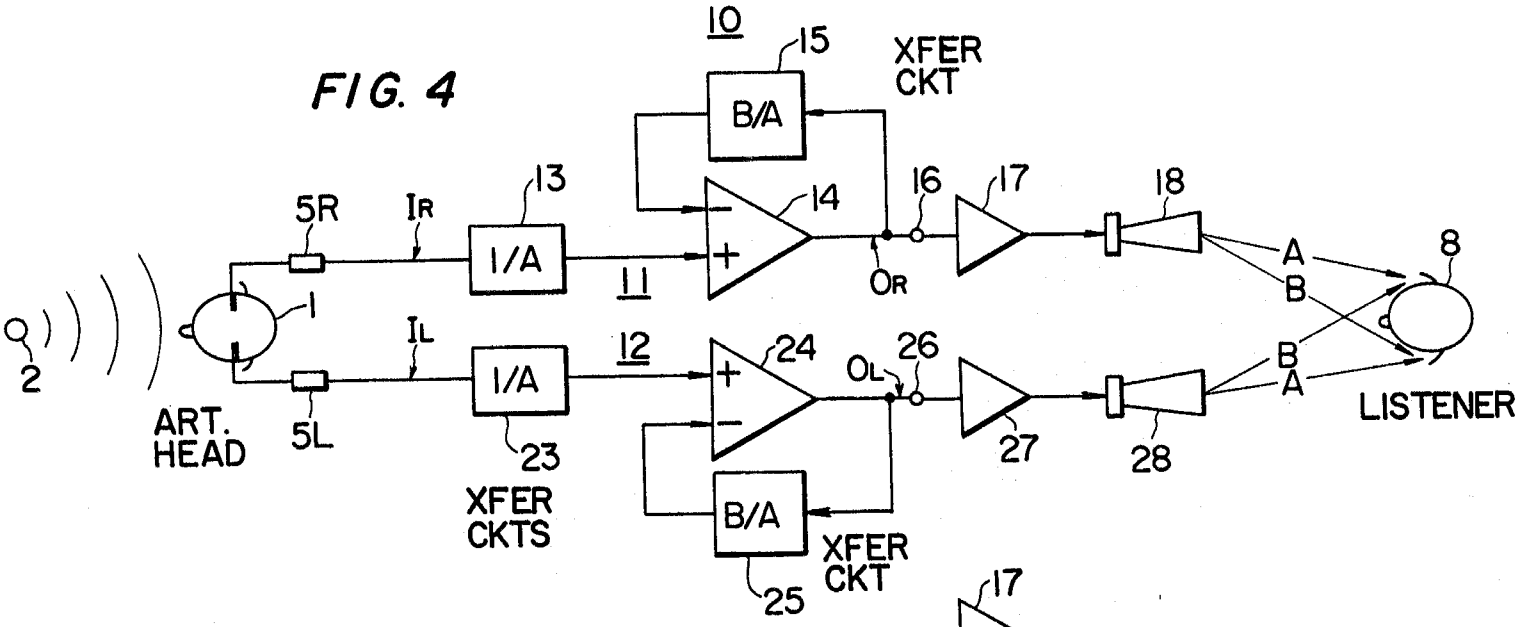
FIG. 4 is a first embodiment of the signal translator of the invention.

In FIG. 4 of the drawings, there is shown a first embodiment of the invention. A right-channel binaural input signal $I_R$ and a left-channel binaural input signal $I_L$ from the microphones 5 are fed into a signal translator 10 which includes a pair of right- and left-channel translating networks 11 and 12. The right-channel translating network 11 is comprised by a transfer circuit 13 having a transfer function which is represented by the inverse of the transfer function A as shown in curve A of FIG. 3, the transfer circuit 13 being connected to receive the right-channel input signal $I_R$ to feed its translated output signal to the noninverting input terminal of a subtractive circuit or unity-gain differential amplifier 14 whose output is in turn connected in a negative feedback loop through a second transfer circuit 15 to the inverting input of the subtractive circuit. The second transfer circuit 15 has a transfer function expressed by B/A, i.e. the ratio of the transfer function B to the transfer function A, or crosstalk ratio. Similarly, the left-channel translating network 12 comprises a transfer circuit 23 having the same transfer function as that of the right-channel transfer circuit 13, a subtractive circuit 24 in receipt of the output signal from the left-channel transfer circuit 23 on its noninverting input terminal to algebraically combine it with a negative feedback signal supplied through a second transfer circuit 25 having the same transfer function as that of right-channel transfer circuit 15 from the output terminal of the subtractive circuit 24.

Mathematical analysis of the circuit of FIG. 4 gives the following Equations:

$$O_R = \frac{1}{A} \cdot I_R - \frac{B}{A} \cdot O_R \tag{1R}$$

$$O_L = \frac{1}{A} \cdot I_L - \frac{B}{A} \cdot O_L \tag{1L}$$

where, $O_R$ and $O_L$ are output signals at terminals 16 and 26, respectively. Rearranging Equations 1R and 1L gives the following Equations:

$$(1 + \frac{B}{A})O_R = \frac{1}{A} \cdot I_R \tag{2R}$$

-continued $$(1+\frac{B}{A})O_L=\frac{1}{A}\cdot I_L \quad (2L)$$

Therefore, $$O_R=\frac{I_R}{A+B} \quad (3R)$$

$$O_L=\frac{I_L}{A+B} \quad (3L)$$

If the sound source 2 is located in the midst of the reproduction stage, $I_R$ can be considered to be substantially equal to $I_L$ so that $I_R=I_L=I$. Thus $O_R$ and $O_L$ are given as follows:

$$O_R=O_L=\frac{I}{A+B} \quad (4)$$

The output signals at terminals 16 and 26 are respectively amplified by linear amplifiers 17 and 27 and supplied to loudspeakers 18 and 28. Therefore, the signal converter 10 has a transfer function 1/(A+B) so that the input signals to the loudspeakers 18 and 28 and I/(A+B) which are converted into acoustic waves and emitted to the listener 8 over the direct path having transfer function A and the crosstalk path having transfer function B. It will be noted therefore the acoustic signal emitted from right-side speaker 18 is transformed into a signal I/(A+B) and the acoustic signal emitted from left-side speaker 28 is transformed into a signal I/(A+B), which are received at the right ear of the listener 8, resulting in a signal I. The listener 8 hears the same sound quality as if he were sitting in the location of the artificial head 1.

Figure 5:
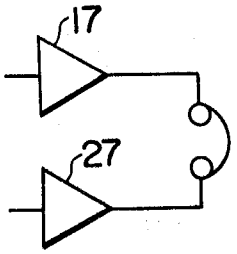
FIG. 5 is an arrangement in which a headphone is connected to the outputs of the translator of FIG. 4 instead of the loudspeakers.
Figure 6:
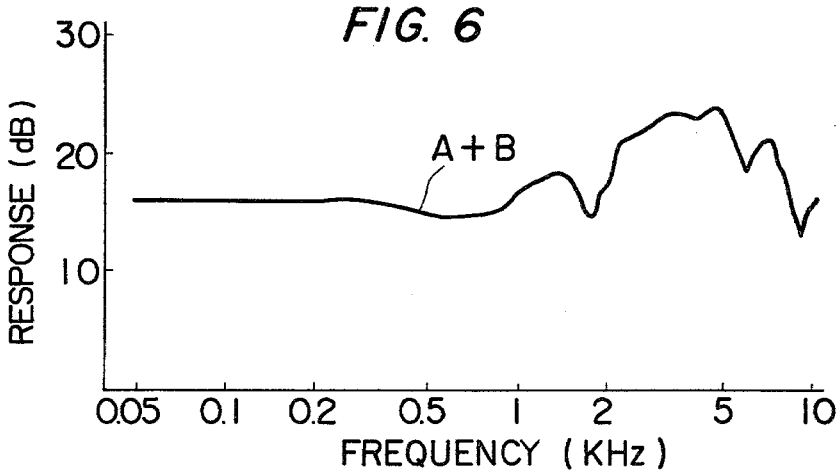
FIG. 6 is a graphic illustration of the response or transfer function of a stereophonic headphone.

Since conventional headphones are generally designed to exhibit a transfer function (A+B) as illustrated in FIG. 6, the use of such a conventional headphone instead of the loudspeakers 18 and 28, as illustrated in FIG. 5, will produce the same sound quality as in the loudspeaker reproduction.

The foregoing description is based on the assumption that the sound source is located in the frontal direction of the artificial head 1. However, in actual practice, the sound source may be located anywhere around the dummy head. Mathematical analysis of such a case involves the solution of a complex formula. This problem can be solved by the use of attenuators illustrated in the embodiment of FIG. 7 in which corresponding parts of FIG. 4 are designated by the corresponding numbers.

Figure 7:
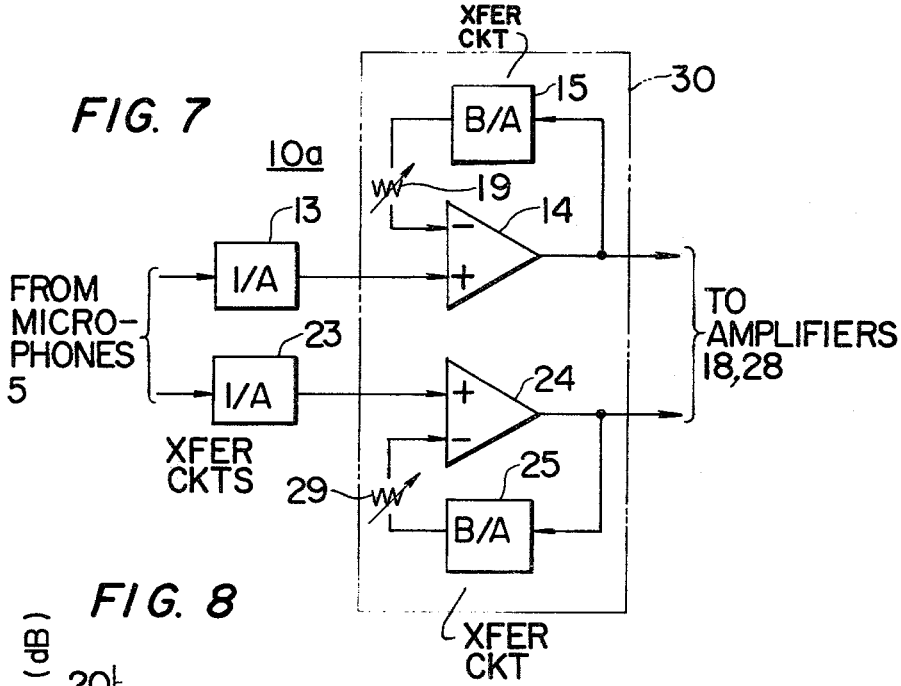
FIG. 7 is a modification of the embodiment of FIG. 4.

In FIG. 7, an attenuator 19 is connected between the output of the transfer circuit 15 and the inverting input of the amplifier 14. Similarly, an attenuator 29 is provided between the output of transfer circuit 25 and the inverting input of amplifier 24. Adjustment of the attenuators 19 and 29 to provide reduction of the feedback components by 3 to 4 dB is found to give satisfactory sound quality with respect to sounds coming in directions other than the frontal direction.

Figure 8:
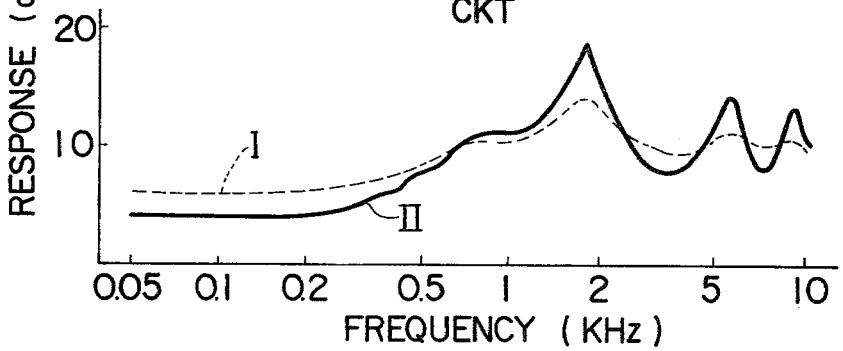
FIG. 8 is a graphic illustration of the frequency response characteristics of the embodiments of FIGS. 4 and 7.

FIG. 8 is a graphic illustration of the frequency response of the portion 30 of the circuit of FIG. 7 in curve I in contrast with the frequency response of the corresponding portion of the circuit of FIG. 4 in curve II. As indicated by curve I, the response has an increase over the lower frequency range of the audio spectrum while the peaks and dips in the middle and high frequency ranges are rendered less sharper than curve II.

The previous embodiments are effective in eliminating waveform distortions accompanying binaural loudspeaker reproduction. However, the localization of sonic images is also an important factor for loudspeaker reproduction of binaural signals if higher quality sound reproduction is desired.

Figure 9:
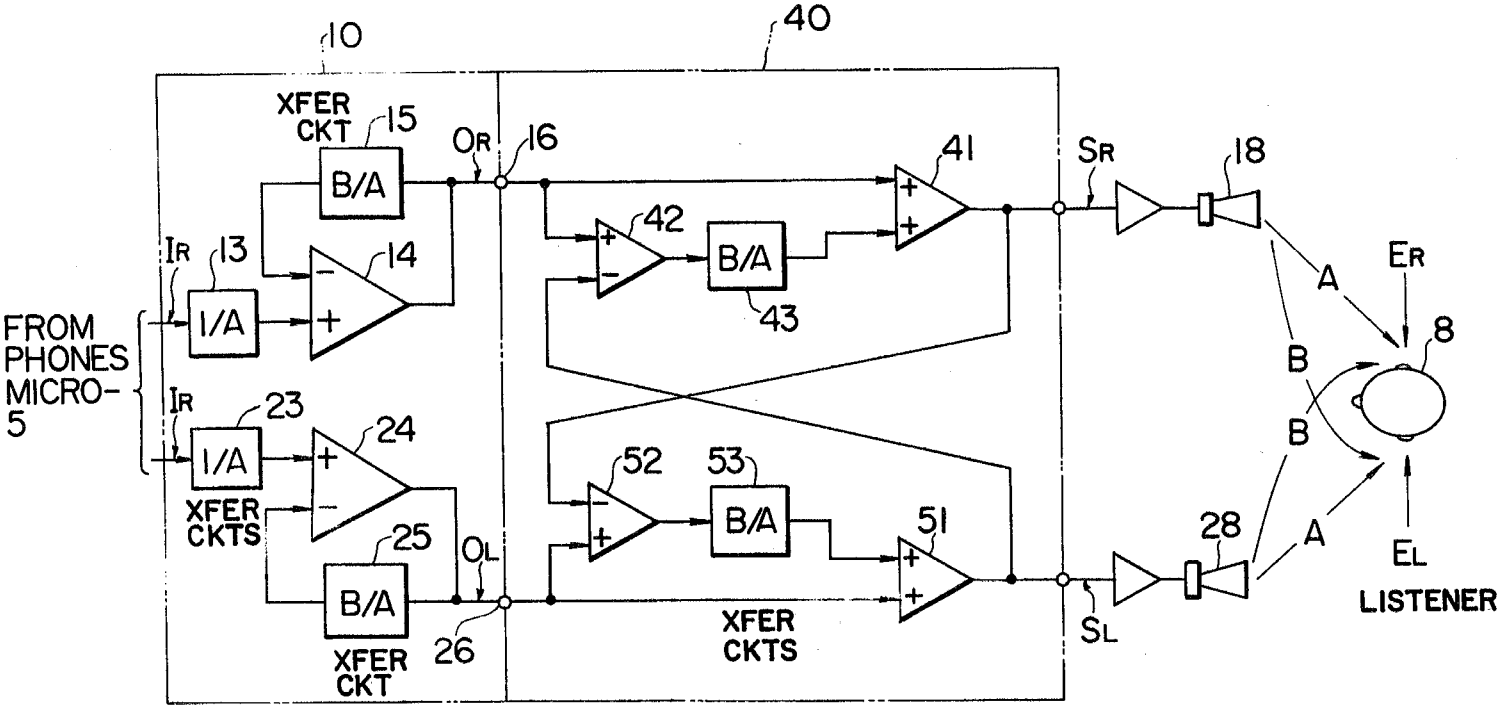
FIG. 9 is a diagram of a crosstalk cancellation network which is shown connected to the outputs of the signal translator of FIG. 4.

An embodiment shown in FIG. 9 is a signal translator which is comprised of the translator 10 of FIG. 4 and a binaural localization network 40 connected in tandem with the translator 10. The network 40 comprises an adder 41 having two input terminals, one of which is connected to the right-channel output terminal 16 of the translator 10 to which is connected the noninverting input of a subtractor or unity gain differential amplifier 42 having an output connected to a transfer circuit 43 having a transfer function expressed by B/A, the output of the transfer circuit 43 being connected to a second input of the adder 41. Similarly, an adder 51 is provided having two inputs, one of which is connected to the left-channel output 26 of the translator 10 to which is connected the noninverting input of a differential amplifier 52 having an output connected through a transfer circuit 53 having a transfer function B/A to the second input of the adder 51. Each of the output terminals of the right-channel adder 41 and the left-channel adder 51 is cross-coupled to the inverting input terminal of the subtractor of the other channel.

Mathematical analysis of the translator 40 gives the following relations:

$$S_R=O_R+\frac{B}{A}\cdot O_R-\frac{B}{A}\cdot S_L \quad (5R)$$

$$S_L=O_L+\frac{B}{A}\cdot O_L-\frac{B}{A}\cdot S_R \quad (5L)$$

where, $S_R$ and $S_L$ are input signals to right and left speakers 18 and 28, respectively. Rearranging Equations 5R and 5L, $$S_R+\frac{B}{A}\cdot S_L=(1+\frac{B}{A})O_R \quad (6R)$$

$$S_L+\frac{B}{A}S_R=(1+\frac{B}{A})O_L \quad (6L)$$

Therefore, $$(1+\frac{B}{A})\begin{bmatrix}O_R\\O_L\end{bmatrix}=\begin{bmatrix}1 & B/A\\B/A & 1\end{bmatrix}\cdot\begin{bmatrix}S_R\\S_L\end{bmatrix} \quad (7)$$

Rearranging Equation 7, $$\begin{bmatrix}S_R\\S_L\end{bmatrix}=\frac{1+B/A}{1-(B/A)^2}\cdot\begin{bmatrix}1 & -B/A\\-B/A & 1\end{bmatrix}\cdot\begin{bmatrix}O_R\\O_L\end{bmatrix} \quad (8)$$

Since, $$\begin{bmatrix}1 & B/A\\B/A & 1\end{bmatrix}^{-1}=\frac{1}{1-(B/A)^2}\begin{bmatrix}1 & -B/A\\-B/A & 1\end{bmatrix}$$

Equation 8 can be rewritten as follows:

$$\begin{bmatrix} S_R \\ S_L \end{bmatrix} = \frac{1}{1 - B/A} \begin{bmatrix} 1 & -B/A \\ -B/A & 1 \end{bmatrix} \cdot \begin{bmatrix} O_R \\ O_L \end{bmatrix} \tag{9}$$

Since Equations 3R and 3L can be rewritten as follows, $$\begin{bmatrix} O_R \\ O_L \end{bmatrix} = \frac{1/A}{1 + B/A} \begin{bmatrix} I_R \\ I_L \end{bmatrix} \tag{10}$$

Equation 9 can be rewritten as follows:

$$\begin{bmatrix} S_R \\ S_L \end{bmatrix} = \frac{1}{1 - B/A} \begin{bmatrix} 1 & -B/A \\ -B/A & 1 \end{bmatrix} \frac{1/A}{1 + B/A} \begin{bmatrix} I_R \\ I_L \end{bmatrix} \tag{11}$$

Since the transfer relations of sound reproduction between speakers 18, 28 and the listener 8 are given by the following matrix, $$\begin{bmatrix} E_R \\ E_L \end{bmatrix} = \begin{bmatrix} A & B \\ B & A \end{bmatrix} \begin{bmatrix} S_R \\ S_L \end{bmatrix} \tag{12}$$

where $E_R$, $E_L$ represent the sound pressure levels at the right and left ears of the listener 8, respectively, Equation 11 can be rewritten as follows:

$$\begin{bmatrix} E_R \\ E_L \end{bmatrix} = \begin{bmatrix} A & B \\ B & A \end{bmatrix} \cdot \frac{1}{1 - B/A} \begin{bmatrix} 1 & -B/A \\ -B/A & 1 \end{bmatrix} \frac{1/A}{1 + B/A} \begin{bmatrix} I_R \\ I_L \end{bmatrix} \tag{13}$$

$$= A \begin{bmatrix} 1 & B/A \\ B/A & 1 \end{bmatrix} \frac{1}{1 - B/A} \begin{bmatrix} 1 & -B/A \\ -B/A & 1 \end{bmatrix} \frac{1/A}{1 + B/A} \begin{bmatrix} I_R \\ I_L \end{bmatrix}$$

$$= \begin{bmatrix} 1 & B/A \\ B/A & 1 \end{bmatrix} \frac{1}{(1 - B/A)(1 + B/A)} \begin{bmatrix} 1 & -B/A \\ -B/A & 1 \end{bmatrix} \begin{bmatrix} I_R \\ I_L \end{bmatrix} \tag{15}$$

Since $$\frac{1}{(1 - B/A)(1 + B/A)} \begin{bmatrix} 1 & -B/A \\ -B/A & 1 \end{bmatrix} = \begin{bmatrix} 1 & B/A \\ B/A & 1 \end{bmatrix}^{-1},$$

Equation 15 is rewritten as $$\begin{bmatrix} E_R \\ E_L \end{bmatrix} = \begin{bmatrix} I_L \\ I_L \end{bmatrix} \tag{16}$$

Therefore, the listener 8 has the same acoustic impression as if he were sitting in the location of the artificial head 1, i.e. he receives the same sound in terms of quality and location of sonic images as he would in the position of the dummy head.

Figure 10:
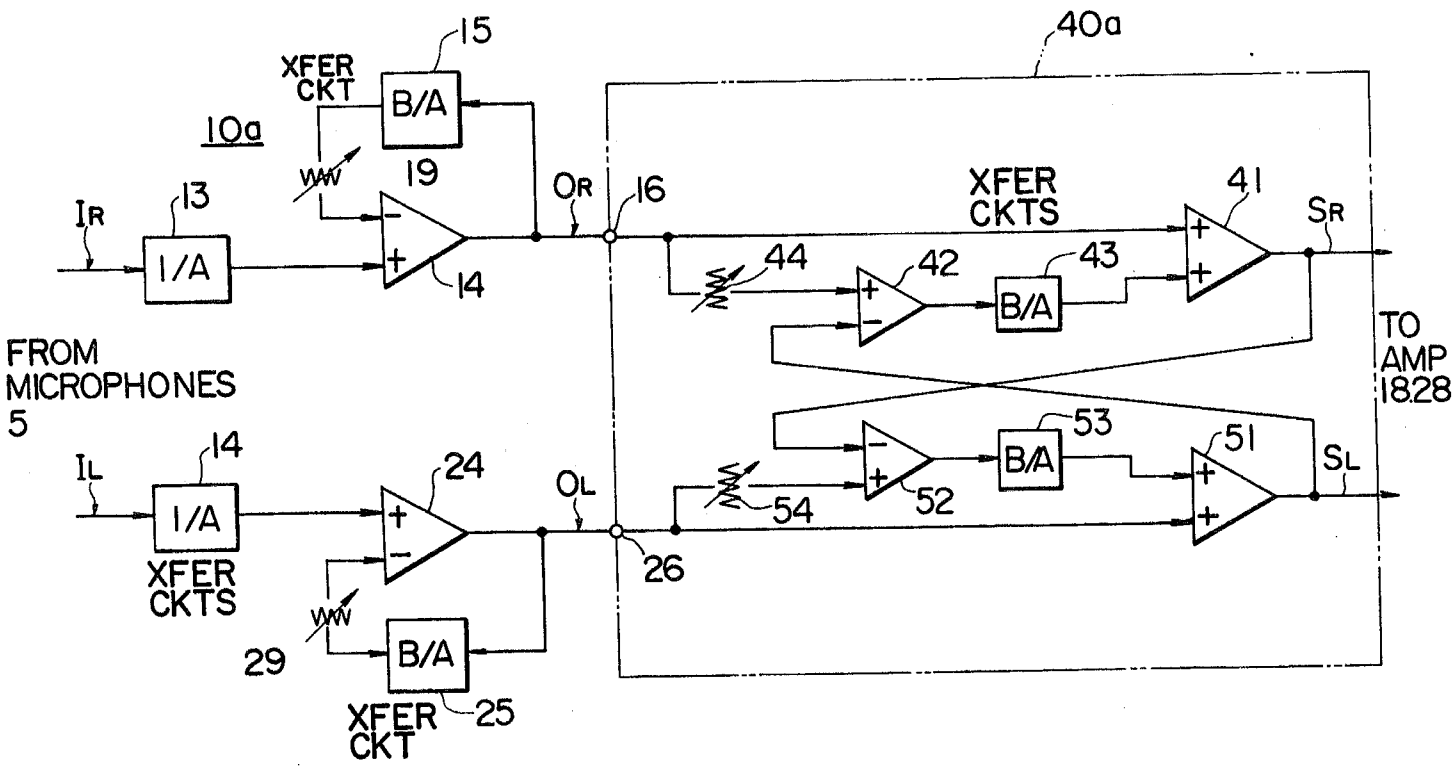
FIG. 10 is a modification of the embodiment of FIG. 9.

The signal translator 40 may be modified as shown in FIG. 10 if it is to be used in conjunction with the translator 10*a* of FIG. 7. In this modification attenuators 44 and 54 are provided as indicated to attenuate the signals from the output terminals 16 and 26 of the previous stage before the signals are applied to the subtractors 42 and 52, respectively. The provision of such attenautors also produces the same acoustic effect as one would hear in the position of the dummy head. This is evidenced by the following mathematical analysis.

The transfer function of the translator 10*a* is expressed as $$\begin{bmatrix} O_R \\ O_L \end{bmatrix} = \frac{1/A}{1 + K(B/A)} \begin{bmatrix} I_R \\ I_L \end{bmatrix} \tag{17}$$

where k is a scaling factor of attenuators 19 and 29 which ranges from zero to unity.

The transfer function of the translator 40*a* is given as follows:

$$\begin{bmatrix} S_R \\ S_L \end{bmatrix} = \frac{1 + K(B/A)}{1 - (B/A)^2} \begin{bmatrix} 1 & -B/A \\ -B/A & 1 \end{bmatrix} \begin{bmatrix} O_R \\ O_L \end{bmatrix} \tag{18}$$

where K is the loss afferred by attenuators 44 and 54. Substituting Equation 17 for $O_R$ and $O_L$ gives, $$\begin{bmatrix} S_R \\ S_L \end{bmatrix} = \frac{1 + K(B/A)}{1 - (B/A)^2} \frac{1/A}{1 + K(B/A)} \begin{bmatrix} 1 & -B/A \\ -B/A & 1 \end{bmatrix} \begin{bmatrix} I_R \\ I_L \end{bmatrix} \tag{19}$$

$$= \frac{1/A}{1 - (B/A)^2} \begin{bmatrix} 1 & -B/A \\ -B/A & 1 \end{bmatrix} \begin{bmatrix} I_R \\ I_L \end{bmatrix}$$

From Euqation 12.

$$\begin{bmatrix} E_R \\ E_L \end{bmatrix} = \begin{bmatrix} A & B \\ B & A \end{bmatrix} \frac{1/A}{1 - (B/A)^2} \begin{bmatrix} 1 & -B/A \\ -B/A & 1 \end{bmatrix} \begin{bmatrix} I_R \\ I_L \end{bmatrix} \tag{20}$$

Since Equation 20 is identical to Equation 13, $$\begin{bmatrix} E_R \\ E_L \end{bmatrix} = \begin{bmatrix} I_R \\ I_L \end{bmatrix} \tag{21}$$

It will be understood that Equation 21 holds if equal degrees of attenuation are provided in the translators 10*a* and 40*a* by means of attenuators 19, 29, 44 and 54.

Figure 11:
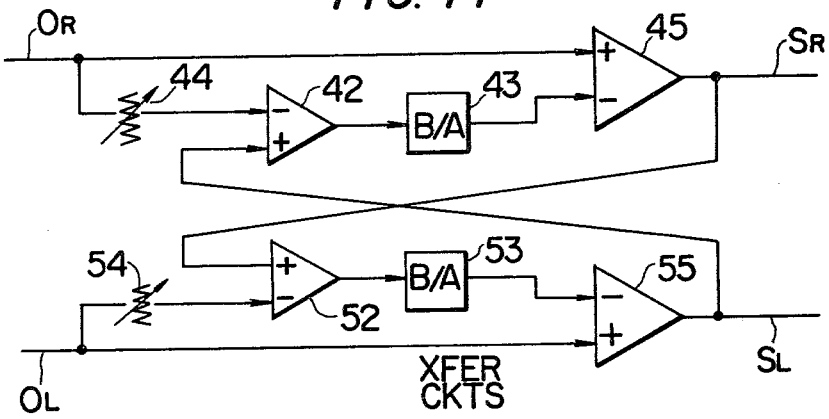
FIGS. 11 to 13 are alternative modifications of the crosstalk cancellation network of FIG. 10.
Figure 12:
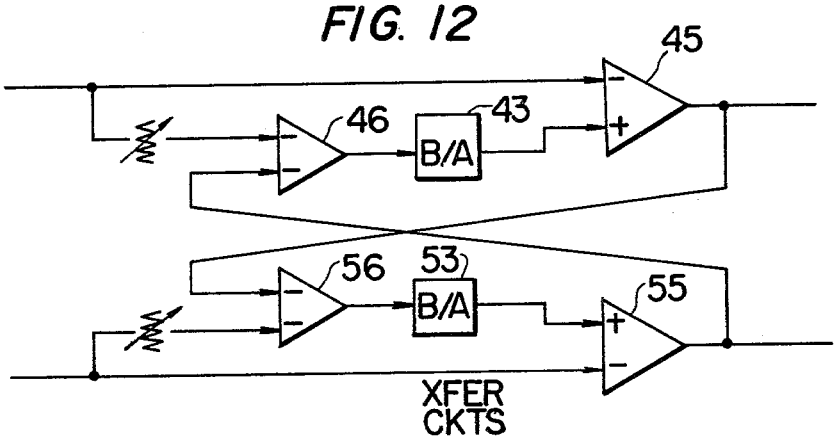
Figure 13:
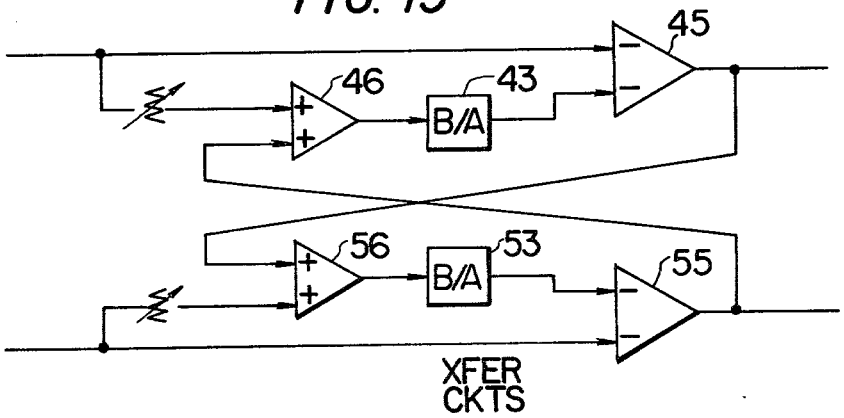

Alternative embodiments of the translator 40a are shown in FIGS. 11 to 13. The embodiment of FIG. 11 is equivalent to the embodiment of FIG. 10 in that the two input terminals of each of the subtractors 42 and 52 of FIG. 10 are reversed in polarity. This requires that the polarity of the output from each of the transfer circuits 43 and 53 be reversed. In this case, adders 41 and 51 may be replaced with subtractors 45 and 55 respectively or an inverter may be interposed in the output circuit of each of the transfer circuits 43 and 53.

In FIG. 12, the circuit is equivalent to the FIG. 11 embodiment in that the polarity of the input terminals of each of the subtractors 45 and 55 of FIG. 11 is reversed. Hence, the FIG. 12 circuit requires the polarity of the input signal to the noninverting input of each of subtractors 42 and 52 be reversed. In this case, subtractors 42 and 52 are represented by minus-sign adders 46 and 56 each of which is obviously realized by the combination of a conventional adder and a pair of inverters connected to the inputs thereto.

FIG. 13 involves the reversal of the polarity of the input terminals of adders 46 and 56 of FIG. 12 so that the circuit of FIG. 13 requires that the noninverting input of subtractors 45 and 55.

Consider now the reproduction of a pair of stereophonic signals with a pair of loudspeakers. The impinging sound at each ear of the listener can be resolved into a direct path component of a speaker signal and a crosstalk path component of the other speaker signal. Whereas, if the same signals are reproduced with a headphone, which is generally designed to have a transfer function (A+B) as described above, the impinging sound at a listener's ear is an algebraical summation of the transformation A of one speaker signal and the transformation B of the same speaker signal, rather than the other speaker signal as in the loudspeaker reproduction. Therefore, the listener has a different acoustic impression when he hears through a headphone from what he would when he hears through loudspeakers.

The description which follows is concerned with signal translation whereby stereophonic signals are converted into a form suitable to reproduce identical acoustic impression to that obtained with loudspeakers.

Figure 14:
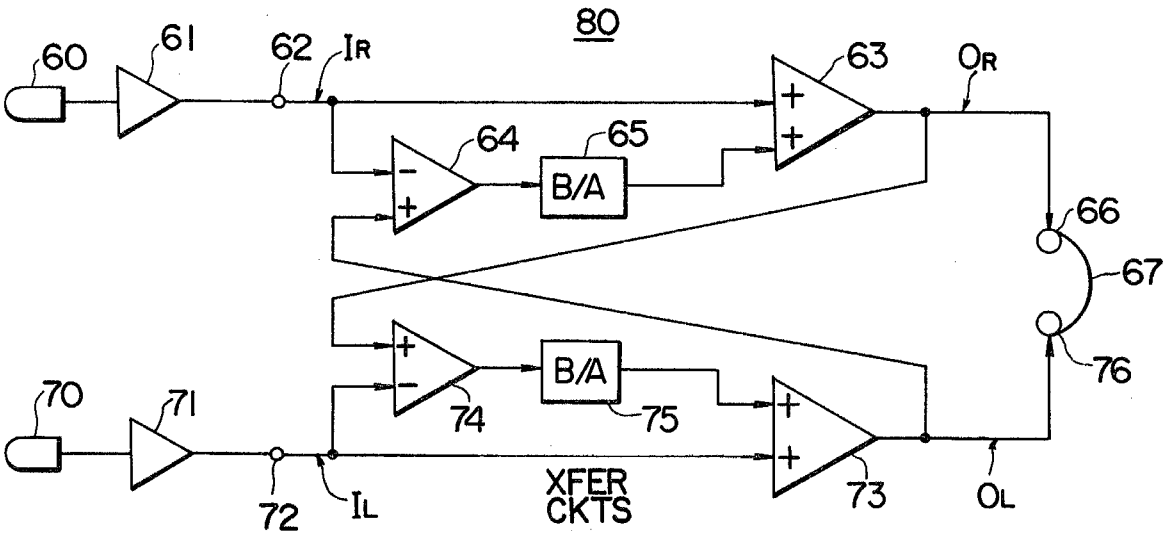
FIG. 14 is an illustration of a second embodiment of the invention.

In FIG. 14 stereophonic signals are respectively derived from a right-channel microphone 60 and a left-channel microphone 70 and amplified by linear amplifiers 61 and 71, and applied to input terminals 62 and 72, respectively, of a signal translator 80. The right-channel signal $I_R$ is applied to a first terminal of an adder 63 and to the inverting input of a subtractor 64 for comparison with the left-channel output signal $O_L$. The output from the subtractor 64 is fed through a transfer circuit 65, having a transfer function B/A, to the second terminal of the adder 63 to be algebraically added with the input signal $I_R$ from terminal 62. In the same fashion, the left-channel input signal $I_L$ is applied to the first input of an adder 73 and also to the inverting input of a left-channel subtractor 74 for comparison with the right-channel output signal $O_R$, the output of the subtractor 74 being fed into a left-channel transfer circuit 75 having the same transfer function as circuit 65 and thence to the second input of the adder 73. The output signals $O_R$ and $O_L$ are applied to right-channel and left-channel earpieces 66 and 76 of a headphone 67, each of which has a transfer function (A+B) as described above.

The mathematical representation of the translator 80 is given as follows:

$$O_R = I_R - \frac{B}{A} I_R + \frac{B}{A} O_L \tag{22R}$$

$$O_L = I_L - \frac{B}{A} I_L = \frac{B}{A} O_R \tag{22L}$$

hence, $$\begin{bmatrix} O_R \\ O_L \end{bmatrix} = \frac{1}{A+B} \begin{bmatrix} A & B \\ B & A \end{bmatrix} \begin{bmatrix} I_R \\ I_L \end{bmatrix} \tag{23}$$

Since each earpiece of the headphone has a transfer function (A+B), the application of right-channel output signal $O_R$ to right earpiece 66 produces an acoustic signal ($I_RA+I_LB$) at the listener's right ear and the application of left-channel output signal $O_L$ to left-earpiece 76 produces an acoustic signal ($I_RB+I_LA$) at the listener's left ear. These acoustic signals are identical to those obtained with loudspeakers.

Figure 15:
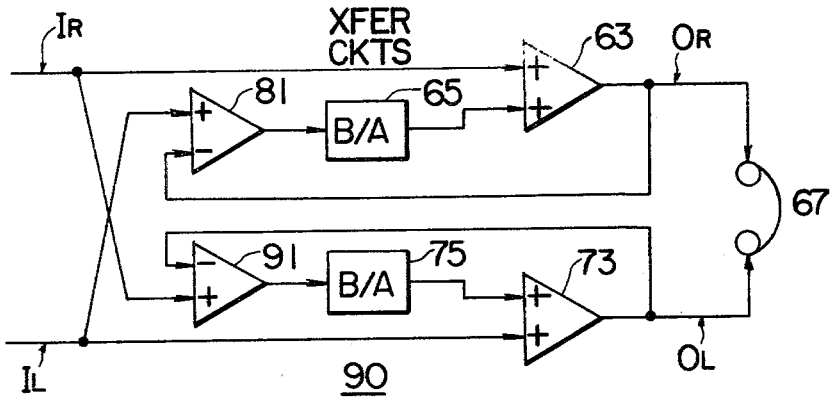
FIGS. 15–16 are modifications of the second embodiment of FIG. 14.

Alternatively, the embodiment of FIG. 14 can be modified as shown in FIG. 15 which differs from the FIG. 14 embodiment in that right-channel input signal $I_R$ is applied to the noninverting input of a left-channel subtractor 91 for comparison with the left-channel output signal $O_L$ and the left-channel input signal $I_L$ is applied to the noninverting input of a right-channel subtractor 81 for comparison with the right-channel output signal $O_R$.

Mathematical analysis of the translator 90 of FIG. 15 gives the following relations:

$$O_R = I_R + \frac{B}{A} I_L - \frac{B}{A} O_R \tag{24R}$$

$$O_L = I_L + \frac{B}{A} I_R - \frac{B}{A} O_L \tag{24L}$$

hence, $$\begin{bmatrix} O_R \\ O_L \end{bmatrix} = \frac{1}{A+B} \begin{bmatrix} A & B \\ B & A \end{bmatrix} \begin{bmatrix} I_R \\ I_L \end{bmatrix} \tag{25}$$

Since Equation 25 is identical to Equation 23, the translator 90 obviously operates in the same way as the translator 80 of FIG. 14.

Although in the foregoing description the headphone is treated as having a transfer function (A+B), there is a distribution of parameters between different heaphones, ranging from those having transfer function (A+B) to those having a transfer function A. It is obviously disadvantageous to use headphones having a transfer function other than (A+B).

Figure 16:
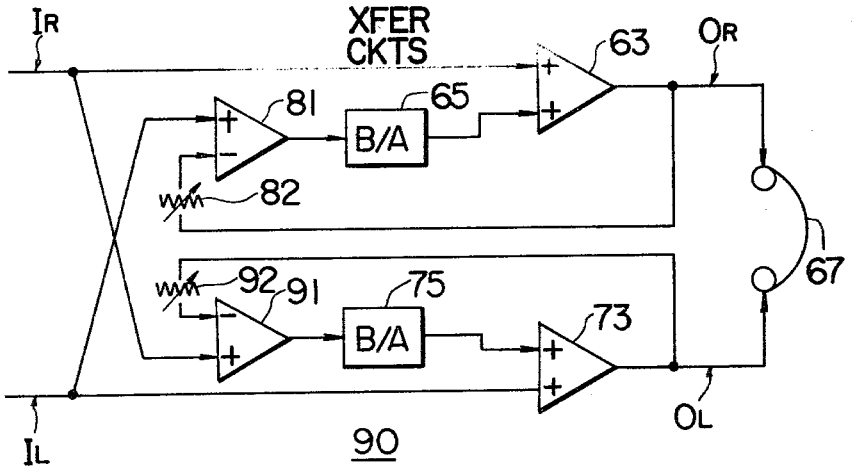

For this purpose attenuators or scaling circuits 82 and 92 are provided as shown in FIG. 16 to scale down the right- and left-channel output signals $O_R$ and $O_L$ by a scaling factor K. The mathematical representation of the translator 90 of FIG. 16 is given as follows:

$$O_R = I_R + \frac{B}{A} I_L - K\frac{B}{A} O_R \tag{26R}$$

$$O_L = I_L + \frac{B}{A} I_R - K\frac{B}{A} O_L \tag{26L}$$

hence, $$\begin{bmatrix} O_R \\ O_L \end{bmatrix} = \frac{1}{A + KB} \begin{bmatrix} A & B \\ B & A \end{bmatrix} \begin{bmatrix} I_R \\ I_L \end{bmatrix} \quad (27)$$

It will be noted from Equation 27 that by adjustment of attenuators 82 and 92 such that K=0, that is, the attenuation loss is infinite, the translator circuit 90 is mathematically represented as $$\begin{bmatrix} O_R \\ O_L \end{bmatrix} = \frac{1}{A} \begin{bmatrix} A & B \\ B & A \end{bmatrix} \begin{bmatrix} I_R \\ I_L \end{bmatrix} \quad (28)$$

Equation 28 is thus suitable for heaphones having transfer function A. By adjustment of attenuators 82 and 92 to have a scaling factor K=1, that is, there is no attenuation loss, Equation 28 becomes equivalent to Equation 25. Therefore, the adjustment of attenuators 82, 92 to have intermediate values between 0 and 1 gives a range of Equations which is suitable for headphones having a transfer function which falls between the transfer functions A and (A+B).

What is claimed is:

1. An audio signal translator for compensating for the difference in characteristics between a multi-channel loudspeaker reproduction system and a multi-channel headphone reproduction system comprising:

a right-channel translating network receptive of one of spatially mutually correlated signals and having a transfer function 1/(A+B); and a left-channel translating network receptive of the other of said correlated signals and having a function 1/(A+B), where A is the transfer function of acoustic paths between right- and left-channel sound reproduction sources of said multi-channel loudspeaker reproduction system and the right and left ears respectively of a listener located with respect to said sound reproduction sources and B is the transfer function of acoustic crosstalk paths between said left- and right-channel sound reproduction sources and said listener's right and left ears respectively.

2. An audio signal translator as claimed in claim 1, for use with a pair of loudspeakers in spaced relation, wherein said spatially corrleated signals are binaural signals.

3. An audio signal translator as claimed in claim 1, for use with a headphone having right- and left-channel earpieces each having a transfer function (A+B), wherein said spatially correlated signals are stereophonic signals.

4. A signal translator as claimed in claim 2, wherein each of said right- and left-channel translating networks comprises:

a first transfer circuit having a transfer function 1/A responsive to the respective binaural signal;

a second transfer circuit having a transfer function B/A;

a subtractive circuit having first and second input terminals receptive of output signals from said first and second transfer circuits respectively, the output signal from said subtractive network being a respective one of said right- and left-channel output signals.

5. A signal translator as claimed in claim 4, further comprising means for scaling the magnitude of the output signal from said second transfer circuit to vary the overall frequency response of said translating circuit.

6. A signal translator as claimed in claim 2, 4 or 5, further comprising a binaural localization network which processes the output signals from said right- and left-channel translating networks to deliver right- and left-channel localized output signals, said localization network comprising:

a right-channel subtractive network having a first input terminal receptive of said right-channel output signal and a second input terminal receptive of said left-channel localized output signal;

a right-channel transfer circuit having a transfer function B/A connected to the output of said subtractive network;

a right-channel additive network having a first input terminal receptive of said right-channel output signal and a second input terminal receptive of an output signal from said right-channel transfer circuit, the output signal from said additive network being said right-channel localized output signal;

a left-channel subtractive network having a first input terminal receptive of said left-channel output signal and a second input terminal receptive of said right-channel localized output signal;

a left-channel transfer circuit having a transfer function B/A connected to the output of said left-channel subtractive network; and a left-channel additive network having a first input terminal receptive of said left-channel output signal and a second input terminal receptive of an output signal from said left-channel transfer circuit, the output signal from said left-channel additive network being said left-channel localized output signal.

7. A signal translator as claimed in claim 6, further comprising first means for scaling the amplitude of said right-channel output signal received by the first input terminal of said right-channel subtractive network and second means for scaling the amplitude of said left-channel output signal received by the first input terminal of said left-channel subtractive network.

8. A signal translator as claimed in claim 3, wherein said right- and left-channel translating networks comprise:

a right-channel subtractive network having a first input terminal receptive of said right-channel stereophonic signal and a second input terminal receptive of an output signal from said left-channel translating network;

a right-channel transfer circuit having a transfer function B/A connected to the output of said subtractive network;

a right-channel additive network having a first input terminal receptive of said right-channel stereophonic signal and a second input terminal receptive of an output signal from said transfer circuit to deliver a right-channel output signal to said headphone said transfer circuit;

a left-channel subtractive network having a first input terminal receptive of said left-channel stereophonic signal and a second input terminal receptive of an output signal from said right-channel translating network;

a left-channel transfer circuit having a transfer function B/A connected to the output of said left-channel subtractive network; and a left-channel additive network having a first input terminal receptive of said left-channel stereophonic signal and a second input terminal receptive of an output signal from said left-channel transfer circuit to deliver a left-channel output signal to said headphone.

9. A signal translator as claimed in claim 3, wherein said right- and left-channel translating networks comprise:

a right-channel subtractive network having a first input terminal receptive of said left-channel stereophonic signal and a second input terminal receptive of said right-channel output signal;

a right-channel transfer circuit having a transfer function B/A connected to the output of said right-channel subtractive network;

a right-channel additive network having a first input terminal receptive of said right-channel stereophonic signal and a second input terminal receptive of an output signal from said right-channel transfer circuit to deliver a right-channel output signal to the right-channel earpiece;

a left-channel subtractive network having a first input terminal receptive of said right-channel stereophonic signal and a second input terminal receptive of said left-channel output signal;

a left-channel transfer circuit having a transfer function B/A connected to the output of said left-channel subtractive network; and a left-channel additive network having a first input terminal receptive of said left-channel stereophonic signal and a second input terminal receptive of an output signal from said left-channel transfer circuit to deliver a left-channel output signal to said left-channel earpiece.

10. A signal translator as claimed in claim 9, further comprising first means connected between the output of said right-channel additive network and the second input terminal of said right-channel subtractive network for scaling the right-channel output signal applied thereto, and second means connected between the output of said left-channel additive network and the second input terminal of said left-channel subtractive network for scaling the left-channel output signal applied thereto.

* * * * *